US006503697B2

(12) United States Patent
Viaene et al.

(10) Patent No.: US 6,503,697 B2
(45) Date of Patent: Jan. 7, 2003

(54) LIGHT-SENSITIVE SILVER HALIDE PHOTOGRAPHIC MATERIAL FOR FORMING DIRECT-POSITIVE IMAGES AND METHOD FOR MAKING SAME

(75) Inventors: Kris Viaene, Bonheiden (BE); Paul Callant, Edegem (BE)

(73) Assignee: Agfa-Gevaert, Mortsel (BE)

( * ) Notice: Subject to any disclaimer, the term of this patent is extended or adjusted under 35 U.S.C. 154(b) by 0 days.

(21) Appl. No.: 09/872,900

(22) Filed: Jun. 2, 2001

(65) Prior Publication Data

US 2002/0004185 A1 Jan. 10, 2002

(30) Foreign Application Priority Data

Jun. 6, 2000 (EP) ..... 00201998

(51) Int. Cl.[7] ..... G03C 1/005; G03C 1/494

(52) U.S. Cl. ..... 430/567; 430/569; 430/570; 430/581; 430/582

(58) Field of Search ..... 430/567, 569, 430/570, 581, 582

(56) References Cited

U.S. PATENT DOCUMENTS

| | | | | |
|---|---|---|---|---|
| 3,759,713 A | | 9/1973 | Florens et al. | 96/126 |
| 3,935,010 A | | 1/1976 | Gilman | 96/27 E |
| 4,059,450 A | | 11/1977 | Vanassche et al. | 96/101 |
| 4,334,001 A | * | 6/1982 | Horie et al. | 430/581 |
| 5,049,483 A | * | 9/1991 | Yatsuyanagi et al. | 430/567 |
| 5,547,828 A | | 8/1996 | Hioki et al. | 430/597 |
| 5,712,077 A | * | 1/1998 | Deprez et al. | 430/567 |
| 6,200,743 B1 | * | 3/2001 | Elst et al. | 430/581 |
| 6,258,522 B1 | * | 7/2001 | Mariotti et al. | 430/567 |
| 6,346,360 B1 | * | 2/2002 | Verbeeck et al. | 430/567 |

FOREIGN PATENT DOCUMENTS

| | | |
|---|---|---|
| EP | 0 057 933 | 8/1982 |
| EP | 0 401 846 | 12/1990 |

* cited by examiner

*Primary Examiner*—Geraldine Letscher
(74) *Attorney, Agent, or Firm*—Joseph T. Guy; Nexsen Pruet Jacobs & Pollard, LLC

(57) ABSTRACT

A black-and-white silver halide photographic material has been disclosed, coated on a support with at least one light-sensitive emulsion layer, comprising a spectrally sensitized prefogged direct-positive silver halide emulsion, providing peak absorption in the wavelength range from 600 nm up to 700 nm, wherein said emulsion comprises a binder and core-shell emulsion crystals having silver bromide in a total amount of at least 80 mole %, characterized in that said emulsion is spectrally sensitized with a combination of a desensitizing dye having an absorption maximum wavelength in a range from 600 nm up to 700 nm, if present as a sole dye in said emulsion, and at least one azacyanine dye having an absorption maximum at a more hypsochromic wavelength.

10 Claims, 3 Drawing Sheets

LIGHT-SENSITIVE SILVER HALIDE PHOTOGRAPHIC MATERIAL FOR FORMING DIRECT-POSITIVE IMAGES AND METHOD FOR MAKING SAME

FIELD OF THE INVENTION

The present invention relates to a light-sensitive silver halide photographic material for forming direct-positive images, in particular computer output (COM) images, and also relates to a method for producing such a light-sensitive direct-positive silver halide photographic material.

BACKGROUND OF THE INVENTION

With recent rapid progress of information transmitting systems, silver halide photographic materials have been increasingly required to have high sensitivity. This high sensitivity is desired as well in the field of negative working as of positive working silver halide photographic materials. A negative working photographic material is known as one giving a negative image while a positive working photographic material is known as one giving a positive image. The term "negative image" means that a reversal image appears while the term "positive image" indicates that no reversal image as an intermediate image appears but that a reproduction of the original image directly appears.

In silver halide photography a photographic method, according to which a positive image is made, is therefore called a direct-positive method and a photographic light-sensitive material and a photographic emulsion for use according to such direct-positive method are called direct-positive material and direct-positive emulsion respectively.

Because of their practical and economical usefulness in the field of e.g. printing out of computer information preference is given nowadays to the use of direct-positive materials and direct-positive emulsions for this purpose.

A variety of direct-positive photographic methods and materials are known. The most useful and well-known methods are following. One method starts subjecting a photographic material comprising silver halide grains that have light-sensitive specks mainly inside the grains to an image-wise exposure and developing the exposed material in the presence of a development nucleator or developing the exposed material after overall light-flashing it to fog. The other method starts exposing a photographic material comprising prefogged silver halide grains to light in the presence of a desensitizing agent and ends with classical processing steps. Such type of emulsion is commonly known as Herschel reversal emulsions and has e.g. been described in U.S. Pat. No. 3,367,778. Silver bromide or silver bromoiodide grains are normally preferred. Said first type can however not be developed in a classical surface developer and requires a supplementary fogging treatment subsequent to the image-wise exposure before or while applying a normal surface development.

The present invention relates to the method wherein use is made of prefogged silver halide emulsions.

Nowadays COM-systems on the market normally make use e.g. of a He/Ne laser (633 nm) and for very short exposure times (flash exposure times of from $10^{-4}$ up to even $10^{-6}$ seconds) it remains difficult to attain the desired sensitivity level. Materials sensitized for light with a wavelength between 600 nm and 700 nm are moreover, as is generally known, not so high in sensitivity. Various proposals have been made in an attempt to solve this problem. So it is a primary condition to spectrally sensitize the emulsion crystals. An optimized spectral sensitization leading to an aborption maximum closely matching the desired maximum absorption wavelength (e.g. at 633 nm in case of He—Ne laser exposure) is thus highly requested.

It has moreover been found that it is favourable to enrich the surface of prefogged grains with iodide ions, as has e.g. been disclosed for the silver chlorobromoiodide grains described in U.S. Pat. No. 5,501,939; in order to provide iodide hole trapping centers, thereby improving the efficiency of the bleaching process of fog centers.

Opposite to the expected increase in sensitivity it has in praxis been established however that such enrichment of the grain surface with silver iodide may even lead to loss in sensitivity, due to a shift in absorption maximum of the spectral sensitizer, in that the said maximum now appeared at a more bathochromic wavelength instead of the wavelength of 633 nm as desired in case of He—Ne laser exposure.

OBJECTS OF THE INVENTION

It is an object of the present invention to provide a silver halide photographic material comprising a layer containing a spectrally sensitized prefogged direct-positive silver halide emulsion having prefogged grains or crystals rich in silver bromide with a grain surface enriched in silver iodide providing an optimized high sensitivity in the range from 600–700 nm, representing the "red light" wavelength range (e.g. 633 nm as wavelength in case of a He—Ne laser exposure), wherein said material, developable in a classical surface developer without a supplementary treatment, provides images of good quality.

It is another object of the present invention to provide a method for obtaining said photographic material.

It is further object of the present invention to provide a method for obtaining an image with said photographic material.

It is a still further object of the present invention to provide a method for obtaining with said photographic material an imaging element having a high sensitivity in COM-applications.

Further objects of the present invention will become apparent from the description hereinafter.

SUMMARY OF THE INVENTION

The above mentioned objects are realized by providing a black-and-white silver halide photographic material coated on a support with at least one light-sensitive emulsion layer, comprising a spectrally sensitized prefogged direct-positive silver halide emulsion, providing peak absorption in the wavelength range from 600 nm up to 700 nm, wherein said emulsion comprises a binder and core-shell emulsion crystals having silver bromide in a total amount of at least 80 mole %, further having, in a shell of said core-shell emulsion crystals, silver iodide in a range from 0.5 up to 20 mole %, based on silver, said shell representing less than 50 mole %, and, more preferably not more than 25 mole %, of all silver precipitated, characterized in that said emulsion is spectrally sensitized with a combination of a desensitizing dye having an absorption maximum wavelength in a range from 600 nm up to 700 nm, if present as a sole dye in said emulsion, and at least one azacyanine dye having an absorption maximum at a more hypsochromic wavelength. In a preferred embodiment said maximum wavelength and said hypsochromic wavelength are differing at least 50 nm, and, more preferably, more than 100 nm. It is thus clear that the desensitizing dye, if present as a sole dye, has an absorption maximum at a more bathochromic wavelength versus the said peak absorption and that presence of said at least one dye or a combination of dyes shifts the absorption spectra towards the desired peak absorption wavelength.

DETAILED DESCRIPTION

Figure 1:
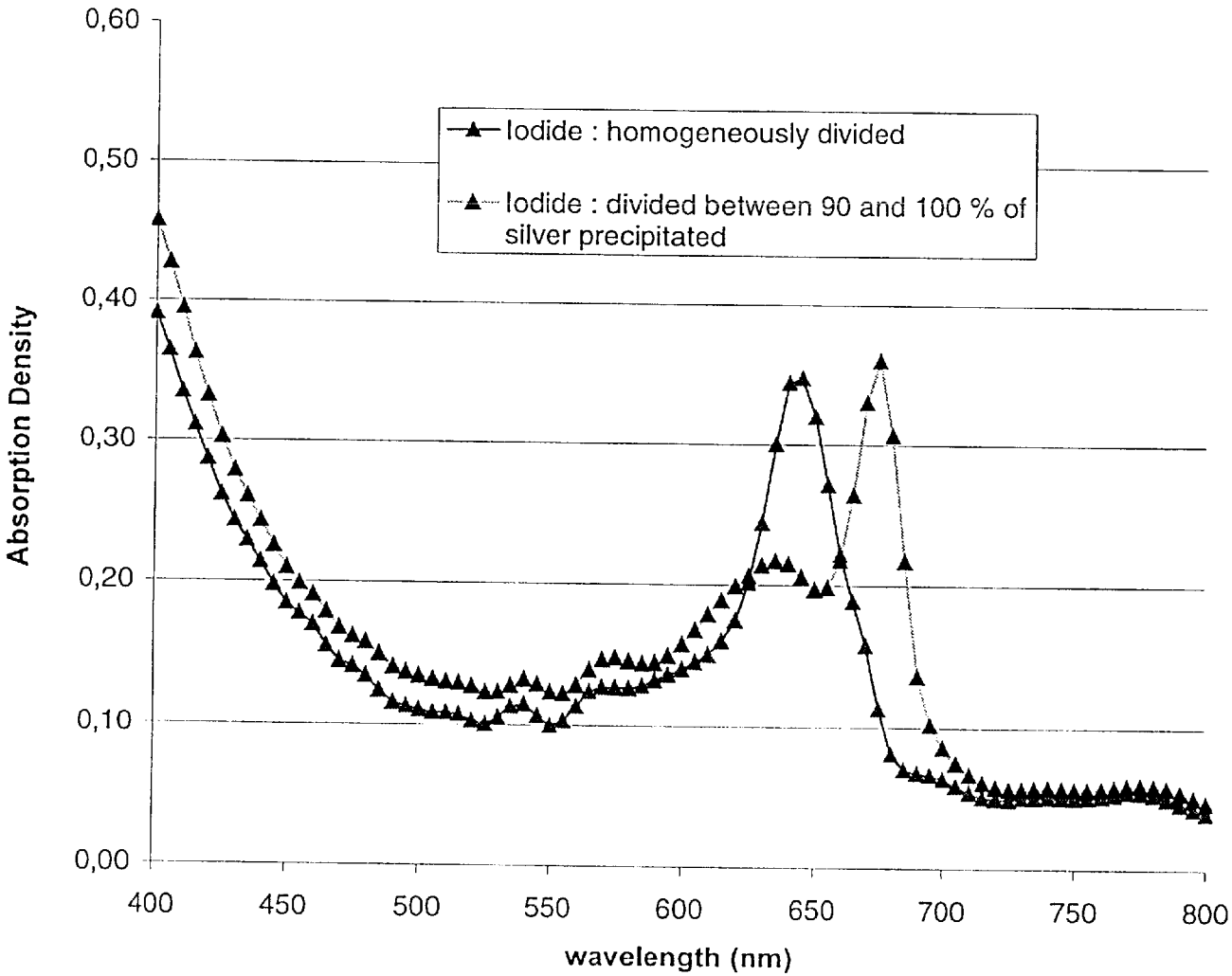
FIG. 1 shows the absorption spectra (measured absorption density as a function of wavelength, expressed in nm) of the Materials D and H, wherein in the direct-positive emulsion emulsions in the respective materials silver iodide has been divided homogeneously (Material D—comparative) or where silver iodide has been divided between 90 and 100 mole % of all silver precipitated (Material H—inventive).

The material according to the present invention thus comprises a spectrally sensitized prefogged direct-positive emulsion, providing peak absorption in the wavelength range from 600 nm up to 700 nm, representing the "red wavelength range" (e.g. peak absorption at He—Ne laser wavelength being 633 nm), and said emulsion layer comprises a (preferably gelatinous) binder and core-shell emulsion grains or crystals dispersed therein, having silver bromide in a total amount of at least 80 mole %, further having, in a shell of said core-shell emulsion crystals, silver iodide in a range from 0.5 up to 20.0 mole %, based on silver, said shell representing less than 50 mole %, and more preferably not more than 25 mole % of all silver precipitated, characterized in that said emulsion is spectrally sensitized with a combination of a desensitizing dye having an absorption maximum at a more bathochromic wavelength versus the desired red wavelength, if present as a sole dye, and at least one dye or a combination of dyes having an absorption maximum at a more hypsochromic wavelength, and wherein said bathochromic and said hypsochromic wavelength are, in a preferred embodiment, differing at least 50 nm and, even more preferred, at least 100 nm. Said desensitizing dye may be whatever a dye having desensitizing action when adsorbed at the surface of the core-shell emulsion grains as set forth, provided that its peak absorption is in the wavelength range from 600 nm up to 700 nm. Suitable electron-accepting sensitizing dyes having an absorption maximum in the "red" wavelength range (as will be called the range from 600 up to 700 nm) include methine dyes such as those described by F. M. Hamer in "The Cyanine Dyes and Related Compounds", 1964, John Wiley & Sons. Dyes that can be used for this purpose include cyanine dyes, merocyanine dyes, complex cyanine dyes, complex merocyanine dyes, homopolar cyanine dyes, hemicyanine dyes, styryl dyes and hemioxonol dyes. Particularly valuable dyes are those belonging to the cyanine dyes, merocyanine dyes, complex merocyanine dyes. Preferred desensitizers are cyanine dyes having an imidazo quinoxaline nucleus, without however being limited thereto. Examples of desensitizers have been given e.g. in U.S. Pat. No. 4,025,347, wherein said cyanine dye is substituted with a benzoyl or a phenylsulfonyl group. Said cyanine dyes Oare characterized by at least one of the following nuclei (or derivatives thereof), being 2,3,3-trimethyl-5-phenyl-sulfonyl-indolenine; 2,3,3-trimethyl-5-benzoyl-indolenine; 1-aryl or alkyl-2-5 phenyl-5-phenyl-sulfonyl-indole; and 1-aryl or alkyl-2-phenyl-5-benzoyl-indole. Besides these useful electron acceptor spectral sensitizers for direct positive silver halide emulsions, having an indole or indolenine nucleus, other desensitizing dyes may be used, such as those described in U.S. Pat. No. 4,404,277, wherein an alkoxyaryl function is joined by a vinylidene linkage to a heterocyclic nucleus; in U.S. Pat. No. 3,468,661 wherein a trimethine dye is containing a benzoyl substituted benzimidazol nucleus; in U.S. Pat. No. 5,026,704 wherein benzo[f]quinoxaline-2,3(1H, 4H)-diones as heterocyclic dihydroxy-quinoxaline compounds are presented; and in U.S. Pat. No. 3,936,308 with photographic emulsions containing methine dyes having a 1H-imidazo[4,5-b]pyrazine nucleus.

A preferred desentizing dye, having an imidazo quinoxaline nucleus, particularly suitable for use in the material according to the present invention, is given hereinafter (see general formula (I) and a preferred derivative thereof—see formula (I.1 ))

(I)

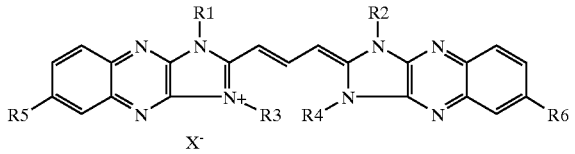

wherein each of R1–R4 each independently represents hydrogen, an (unsubstituted or substituted) alkyl, an (unsubstituted or substituted) aryl or an (unsubstituted or substituted) aralkyl; wherein R5 and R6 each independently represents an electron withdrawing group due and wherein $X^-$ represents an anion compensating for the positive charge present in said formula (I). Apart from said anion the presence of which is due to the tetravalent nitrogen atom present, other charge compensating groups may be present as the alkyl, aryl, and aralkyl group can be substituted and can, in that case, have as substituents a sulfonic acid group, a carboxylic acid group, etc., which require a hydrogen ion or another (complex) cation as charge compensating ion.

The formula of a preferred imidazo quinoxaline dye is given hereinafter as formula (I.1)

(I.1)

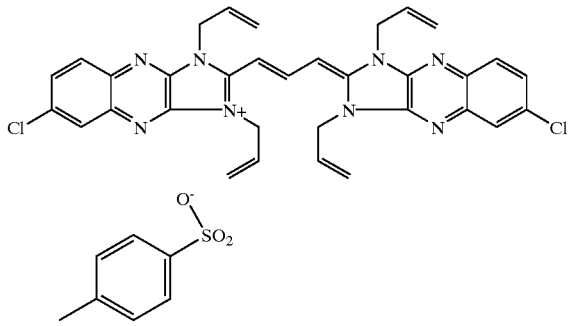

In U.S. Pat. No. 5,547,828 a direct positive type silver halide photographic material comprising a mixture of dyes in favour of high reversal sensitivity and reduced in residual coloring has been disclosed. Therein said mixture is containing at least one compound represented by the formula (I) or analogous structures as presented therein and at least one cyanine dye having a pyrazolo[5,1-b] quinazolone nucleus and a 5- or 6-membered nitrogen-containing heterocyclic ring, wherein a carbon atom at the 3-position of the pyrazolo [5,1-b]quinazolone nucleus is bonded through a four-methine chain to an atom at the 2-position or 4-position of the 5- or 6-20 membered nitrogen-containing heterocyclic ring, provided that the 4-position is possible only when the 5- or 6-membered nitrogen-containing heterocyclic ring is a quinoline or pyridine nucleus.

In the present invention however an optimized high sensitivity in the red wavelength range, and as specifically illustrated e.g. for He—Ne laser irradiation having peak absorption at 633 nm, is thus attained by making use of a mixture of a cyanine dye having an imidazo quinoxaline nucleus as the (preferred) dye according to the general formula (I), already presented before in U.S. Pat. No. 3,431,111, which shows an absorption maximum at a more bathochromic wavelength in the wavelength range of from 600 up to 700 nm, and in a more particular embodiment, versus the particular He—Ne laser wavelength of 633 nm, if present as a sole dye, adsorbed at the emulsion crystal faces of core-shell emulsion crystals having silver bromide in a total amount of at least 80 mole %, further having, in a shell of said core-shell emulsion crystals, silver iodide in a range from 0.5 up to 20.0 mole %, based on silver, wherein said shell representing less than 50 mole %, and more preferably not more than 25 mole % of all silver precipitated; and a at least one dye or a combination of dyes having an absorption maximum at a more hypsochromic wavelength versus the desired wavelength.

In a preferred embodiment said bathochromic and said hypsochromic wavelength are differing at least 50 nm, and even more preferred at least 100 nm. According to the present invention said at least one dye or a combination of dyes having an absorption maximum at a more hypsochromic wavelength is (are) (an) azacyanine dye(s).

Azacyanine dyes according to the formulae (II.1–II.5) are particularly suitable, but presence, in addition to the said azacyanine dye(s) of monomethine cyanine and/or styryl cyanine dyes as those represented by the formulae (III.1–III.7) and (IV.1–IV.3) respectively given hereinafter, is not excluded:

(II-1)

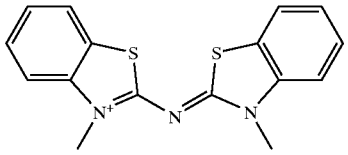

$^-$OTos (II-2)

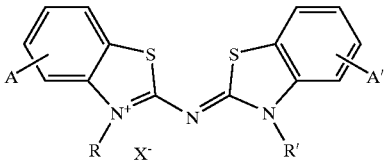

(II-3)

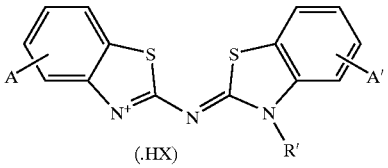

(.HX)

-continued (II-4)

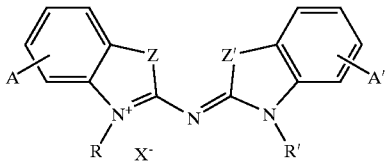

Z,Z′ = O,S,(Se)

(II-5)

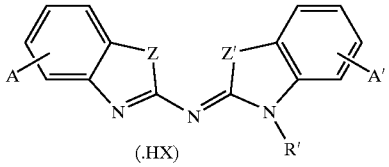

(.HX)

(II-4′)

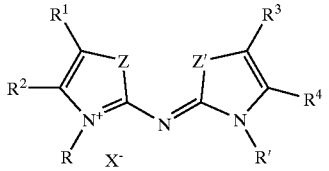

(II-5′)

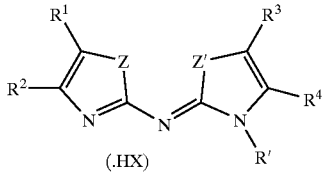

(.HX)

(III-1)

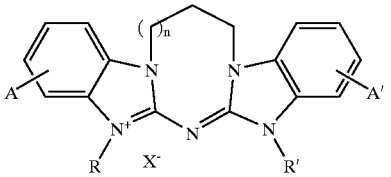

n =0,1

(III-2)

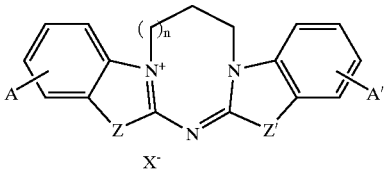

n = 0,1
Z, Z′ = S,O, (NR)

(III-3)

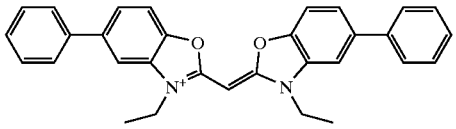

$^-$OTos (III-4)

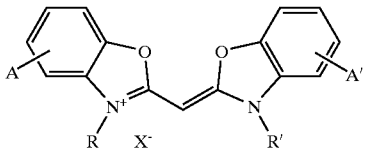

-continued (III-5)

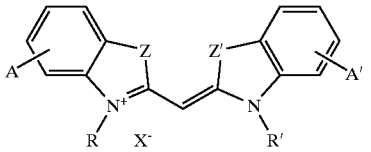

Z, Z' = S, O, (NR)

(III-6)

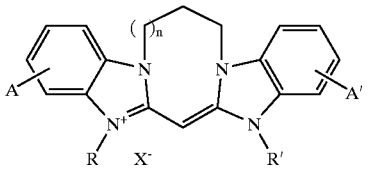

n = 0,1

(III-7)

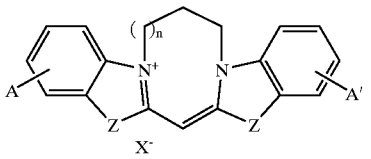

n = 0,1
Z, Z' = S, O, (NR)

(IV-1)

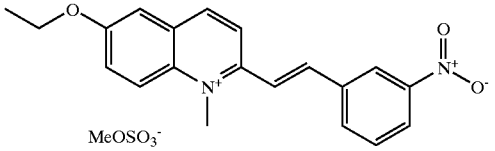

(IV-2)

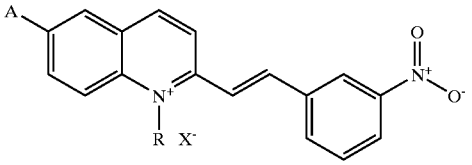

A = H, OR', halogen,
R = (subst.) alkyl
X = counterion (IV-3)

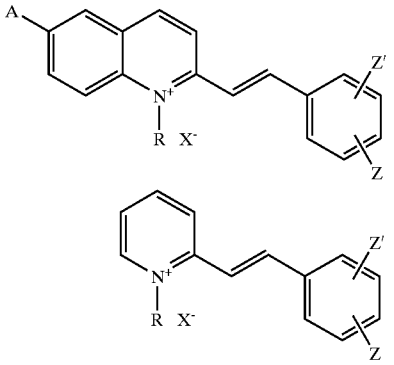

A = H, OR', halogen,
R = (subst.) alkyl
X = counterion
Z, Z' = electron accepting group wherein each of the substituents A and A' independently represents hydrogen, an (unsubstituted or substituted) alkyl, an (unsubstituted or substituted) aryl or an (unsubstituted or substituted) aralkyl; wherein R and R' each independently represents an (unsubstituted or substituted) alkyl, an (unsubstituted or substituted) aryl or an (unsubstituted or substituted) aralkyl group; and wherein cations or anions are present in order to compensate the charge of the dye molecule.

More particularly preferred each of R and R' independently represents $(CH_2)_nH$ or $(CH_2)_nOH$, n being an integer having a value from 1 to 4, $(CH_2)_m(SO_3^-)$ or $(CH_2)_mO(SO_3^-)$, m being an integer having a value from 2 to 4, $(CH_2)_2CH(Y)SO_3^-$ wherein Y represents $CH_3$—, —Cl or —OH;

$(CH_2)_mN(R)SO_3^-$ or $(CH_2)_mN(R')SO_3^-$ $(CH_2)_n(COO^-)$ or $(CH_2)_n(COOH)$, $(CH_2)_sSO_2^-(CH_2)_tH$ wherein s equals 2 or 3 and t equals 1 or 2;

$(CH_2)_x$-Phen-W, wherein W represents —$COO^-$ or $SO_3^-$; Phen represents phenyl which is substituted or unsubstituted; and x equals 1, 2, 3 or 4, $(CH_2)_nCONHSO_2R$ or $(CH_2)_nCONHSO_2R'$, provided that R' may represent hydrogen as set forth hereinbefore or a latent solubilizing group as, e.g., $(CH_2)_m$—(C=O)—O—$CH_2$—(C=O)—$CH_3$, wherein m' is an integer having a value of from 1 to 5.

In order to get neutral azacyanine structures preferred charge compensating cations are $Li^+$, $Na^+$, $K^+$, $HN^+Et_3$, wherein Et represents ethyl, whereas preferred charge compensating anions are $Cl^-$, $Br^-$, $I^-$, $^-$OTos, $^-$OMes, $CF_3SO_3^-$, wherein $^-$OTos represents tosylate and $^-$OMes represents mesylate.

Specific suitable examples of azacyanine dyes are given in the formulae (II.6) to (II.16) hereinafter:

(II.6)

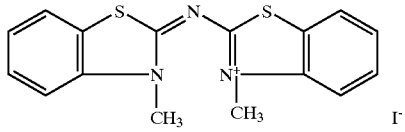

(II.7)

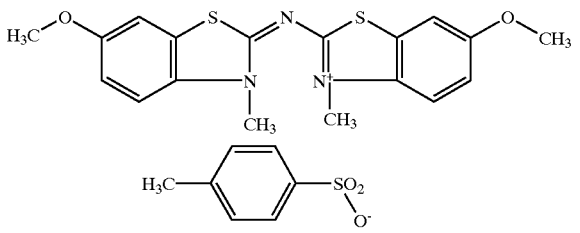

(I.8)

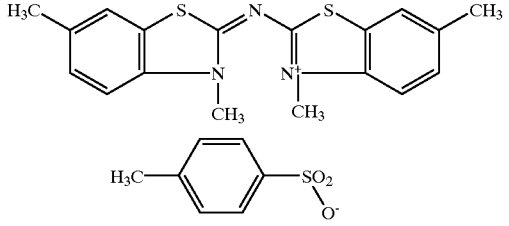

-continued (II.9)

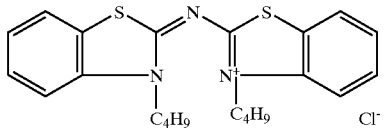

(II.10)

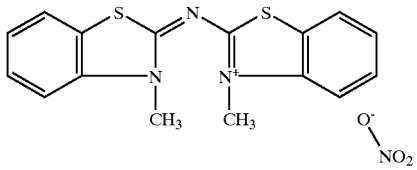

(II.11)

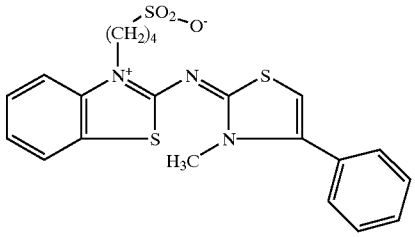

(II.12)

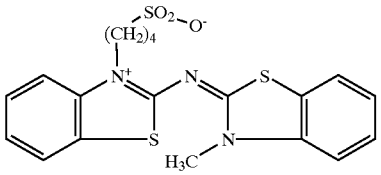

(II.13)

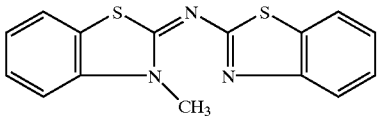

(II.14)

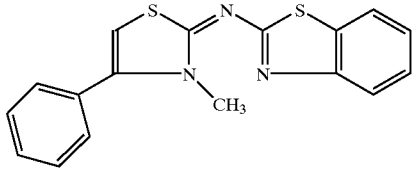

(II.15)

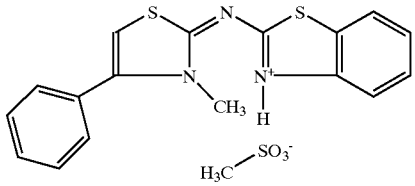

(II.16)

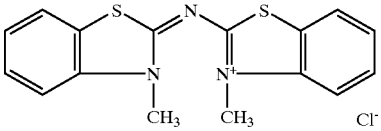

Particularly preferred is the compound (II.17) hereinafter:

(II.17)

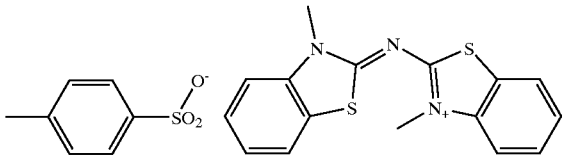

After extensive research it has been found that a silver halide photographic material containing on a support at least one layer comprising a spectrally sensitized prefogged direct-positive silver halide emulsion, wherein the emulsion crystals are spectrally sensitized with a combination of dyes as disclosed hereinbefore, provides the expected optimized sensitivity for "red light" exposure when the silver halide crystals, dispersed in a binder, are core-shell emulsion crystals having silver bromide in a total amount of at least 80 mole %, further having, in a shell of said core-shell emulsion crystals, silver iodide in a range from 0.5 up to 20.0 mole %, based on silver, wherein said shell represents less than 50 mole % and, in a preferred embodiment, not more than 25 mole %, of all silver precipitated. Preferably iodide is built-in into the silver halide crystals by adding one or more water soluble iodide salts to the emulsion of said silver halide crystals in the formation stage after the addition of at least 50% of the silver salt and before the onset of the prefogging, more preferably after the addition of 75% of the silver salt and before the end of the desalting of the emulsion. Said water soluble iodide salts are added to the emulsion of the silver halide crystal in the growth stage of the shell in a total amount of from 0.5 mole % up to 20 mole %, so that an average iodide content can be calculated therefrom. Water soluble iodide salts can also be added to the emulsion of the silver halide crystals in a latter stage after all silver has been precipitated. The water soluble iodide salt(s) can be added to the emulsion of the silver halide crystals in the shell formation stage and/or at the end of shell growth in form of solids but are preferably added as aqueous solutions. Preferably sodium and potassium iodide are used, but other agents, as e.g those releasing iodide during and/or after precipitation, wherein said iodide becomes incorporated in the crystal lattice of the silver halide emulsion grains or crystals as has been disclosed in U.S. Pat. Nos. 5,389,508; 5,482,826; 5,498,516; 5,525,460; 5,527,664. Although a mixture of these salts can be used, the use of a sole iodide salt is preferred. Most preferred however is the use of potassium iodide in an aqueous solution.

Those silver halide core-shell emulsions consisting of a core and at least one shell with differing halide compositions may be further modified by incorporation of polyvalent metal ion dopant in the core grains and/or in the shell(s) during their formation. Metal dopant(s) can be added to the reaction vessel prior to precipitation or can be added to one or more of the solutions taking part in the precipitation. Preferred polyvalent metal dopants are elements of group VIII of the Periodic System, e.g. iridium, as disclosed in U.S. Pat. No. 3,367,778, rhodium or ruthenium. In the silver halide crystals Rh3+, Ir4+, Ru4+, etc., are present as dopants in the core and/or to the shell of the emulsion, addition to the core being preferred as disclosed in EP-A 0 743 553 or in EP-A 1 058 150. Preferably addition of said dopants proceeds in form of a soluble salt or a coordination complex. Concentration ranges between $10^{-8}$ and $10^{-4}$ mole per mole of silver halide are usually applied.

The photographic silver halide emulsion(s) used in accordance with the present invention can be prepared from soluble silver salts and soluble halides according to different methods as described e.g. by P. Glafkides in "Chimie et Physique Photographique", Paul Montel, Paris (1967), by G. F. Duffin in "Photographic Emulsion Chemistry", The Focal Press, London (1966), and by V. L. Zelikman et al in "Making and Coating Photographic Emulsion", The Focal Press, London (1966). The emulsions can show a coarse, medium or fine average grain size and be bounded by (100), (111), (110) crystal planes or combinations thereof. Also high aspect ratio tabular core-shell emulsion grains can be contemplated as disclosed in U.S. Pat. No. 4,504,570. According to the present invention emulsion grains in the light-sensitive layer(s) of the material according to the present invention and moreover the preferred crystal habit is cubic and the grains rich in silver bromide have iodide in an average molar amount based on silver of from 0.1 mole % up to 20 mole %, and more preferably of from 0.1 mole % up to 10 mole %. Said grains rich in silver bromide preferably are cubic grains, having an average crystal diameter in the range from 0.05 to 0.50 $\mu$m, preferably from 0.05 to 0.25 $\mu$m and most preferably from 0.05 to 0.20 $\mu$m.

The silver halide emulsion is desalted by one of the well known techniques e.g. by floculating said silver halide emulsion, washing it with water or an aqueous solution and redispersing it, by ultrafiltration, by dialysis, etc. Preferably, the desalination of the silver halide emulsion is carried out before the prefogging of the silver halide emulsion, but can also be carried out afterwards.

The prefogging of the silver halide emulsions for use in accordance with the present invention may be effected by overall exposing a silver halide emulsion to light and/or by chemically prefogging a silver halide emulsion. Chemical fog specks are preferred and may be obtained by various methods. Chemical prefogging may be carried out by reduction or by a compound which is more electropositive than silver e.g. gold salts, platinum salts, iridium salts etc., or a combination of both. Reduction prefogging of the silver halide grains may occur by high pH and/or low pAg silver halide precipitation or digestion conditions e.g. as described by Wood J. Phot. Sci. 1 (1953), 163 or by treatment with reducing agents e.g. tin(II) salts which include tin(II) chloride, in complexes and tin chelates of (poly)amino(poly) carboxylic acid type as described in British Patent 1,209, 050, formaldehyde, hydrazine, hydroxylamine, sulphur compounds e.g. thiourea dioxide, phosphonium salts e.g. tetra (hydroxymethyl)-phosphonium chloride, polyamines e.g. diethylenetriamine, bis (p-aminoethyl) sulphide and its water-soluble salts, hydrazine derivatives, alkali arsenite, amine borane etc. or mixtures thereof. When prefogging of the silver halide grains occurs by means of a reducing agent e.g. thiourea dioxide and a compound of a metal more electropositive than silver especially a gold compound, the reducing agent is preferably used initially and the gold compound subsequently. However, the reverse order can be used or both compounds can be used simultaneously. In addition to the above described methods of chemically prefogging chemical prefogging can be attained by using said fogging agents in combination with a sulphur-containing sensitizer, e.g. sodium thiosulphate or a thiocyanic acid compound e.g. potassium thiocyanate. A preferred way for prefogging a silver halide emulsion suitable for use in accordance with the present invention is the addition of potassium chloroaurate in an amount from 0.5 mg/mole AgX to 2.5 mg/mole AgX to said emulsion at a pH from 5 to 8, at a pAg from 5 to 7, both measured at 50° C., and at a temperature from 40° C. to 70° C. within a time varying from 2 up to 8 hours. Prefogged direct positive silver halide emulsions preferably comprise exterior electron traps. Prefogged direct-positive silver halide emulsions with exterior electron-traps are emulsions having adsorbed to the surface of the prefogged silver halide grains a compound accepting electrons e.g. electron-accepting dyes which may provide spectral sensitization or not or desensitizing compounds as described in e.g. the British Patent Specification 723,019. According to Sheppard et al. J. Phys. Chem, 50 (1946), 210; desensitizers are dyestuffs whose cathodic polarographic half-wave potential, measured against the calomel electrode, is more positive than −1.0 V. It is well kown to characterize these electron-accepting or desensitizing compounds by means of their polarographic half-wave potential. Electron acceptors suitable for use in the direct-positive silver halide emulsions of the present invention have an anodic polarographic half-wave potential and a cathodic half-wave potential that when added together give a positive sum. Methods of determining these polarographic half-wave potentials have been described, e.g., in U.S. Pat. Nos. 3,501,310 and 3,531,290.

Prefogged direct positive silver halide emulsions for use in the material according to the present invention comprise one or more electron-accepting spectral sensitizers as exterior electron trap in a total amount of at least 0.15 mmole/mole of silver, preferably in a total amount of at least 0.30 mmole/mole, more preferably in a total amount from 0.50 mmole/mole up to 2.50 mmole/mole, and most preferably in a total amount from 0.80 mmole/mole to 1.60 mmole/mole.

Although the way of adding the dye or dye(s) to the silver halide emulsion crystals is not critical, it is preferred to add the dye or dye mixture of the dyes according to the general formulae (II), and, optionally in addition thereto, dyes according to the general formula (III) or (IV), before addition of the desensitizing dye according to the formula (I). A preferable molar ratio amount between said azacyanine dye(s) according to the general formula (II) on one hand and the desensitizing dye according to the formula (I) at the other hand is from 1:1 up to 5:1, and more preferably in the range of about 1:1 to 2:1, said ratio of 2:1 being most preferred.

The layer of the photographic material comprising a prefogged direct-positive silver halide emulsion also contains a binder. Said binder normally is a gelatinous binder in which the emulsion crystals are dispersed and which was already present as protective colloid in the reaction vessel from the early nucleation step in the precipitation of silver halide.

The silver halide emulsion is thus spectrally sensitized by the combination of dyes as said forth hereinbefore accordingly with the spectral emission of the exposure source for which the photographic element is designed, and in a preferred embodiment thereof, the dye absorption maximimum perfectly fits with the exposure maximum wavelength. other dyes, which per se do not have any spectral sensitization activity, or certain other compounds, which do not substantially absorb visible radiation, may have a supersensitization effect when they are incorporated together with said spectral electron-accepting sensitizing agents into the emulsion. Suitable supersensitizers are i.a. heterocyclic mercapto compounds containing at least one electronegative substituent as described e.g. in U.S. Pat. No. 3,457,078, aromatic organic acid/formaldehyde condensation products as described e.g. in U.S. Pat. No. 3,743,510, and azaindene compounds. Preferred supersensitizers are pyridinium and chinolium derivatives and nitrogen-containing heterocyclic ring-substituted aminostilbene compounds as described e.g. in U.S. Pat. No. 2,933,390 and U.S. Pat. No. 3,635,721.

Said compounds capable of acting as exterior electron traps and said supersensitizers are preferably added to the silver halide emulsion after the end of the prefogging, more preferably as the next step. When not only electron-accepting spectral sensitizers are used but also other desensitizing dyes or compounds or supersensitizers, said electron-accepting spectral sensitizers are preferably added after the other above mentioned compounds, but they can also be added before or between the addition of said above mentioned compounds.

The direct positive silver halide emulsions may contain emulsion stabilizers. Suitable direct-positive silver halide emulsion stabilizers are azaindenes, preferably tetra- or penta-azaindenes, especially those substituted with hydroxy- or amino-groups. Compounds of this kind have been described by BIRR in Z. Wiss. Photogr. Photophys. Photochem. 47, 2–27 (1952).

Other suitable direct-positive silver halide emulsion stabilizers are i.a. heterocyclic mercapto compounds, quaternary benzothiazole derivatives, besides other classical heterocyclic nitrogen-containing compounds. Examples of such compounds have been disclosed in e.g. EP-A 0 496 127. Other suitable direct positive silver halide emulsion stabilizers are e.g. benzenethiosulphonic acid, benzenethiosulphinic acid, benzenethiosulphonic acid amide. Said stabilizers can be added to the silver halide emulsion prior to, during, or after the prefogging thereof and mixtures of two or more of these compounds can be used. The direct-positive silver halide emulsion may contain other ingredients such as development accelerators, preferably polyalkylene-oxide derivatives having a molecular weight of at least 400, such as those described in e.g. U.S. Pat. Nos. 3,038,805; 4,038,075 and 4,292,400, wetting agents and hardening agents for gelatin may be present. The direct-positive silver halide material may comprise light-screening dyes that absorb scattering light and thus promote the image sharpness. Suitable light-absorbing dyes have e.g. been described in U.S. Pat. Nos. 4,092,168; 4,311,787, DE-P 2,453,217. These light-screening dyes may be present in a antihalation undercoat, in the emulsion layer, in the protective overcoat, etc. In the present invention however the dyes are preferentially added to a backing layer. In a preferred embodiment in connection with the present invention the backing layer is provided at the non-light sensitive side of the support. This layer which also serves as anti-curl layer can contain i.a. matting agents e.g. silica particles, lubricants, antistatic agents and the usual ingredients like hardeners and wetting agents. The backing layer can consist of one single layer or a double layer pack. The hydrophilic layers usually contain gelatin as hydrophilic colloid binder.

Mixtures of different gelatins with different viscosities can be used to adjust the rheological properties of the layer.

More particularly pentamethine oxonol dyes are suitable for use in an antihalation backing layer of the material according to the present invention, as such blue colored dyes are absorbing red light. Said dyes, a representative example of which has been given in the formula (V) hereinafter, have e.g. been described in JP-A's 5-066522, 6-075314 and 5-297527, as well as in U.S. Pat. Nos. 5,366,845 and 5,482,813.

(V)

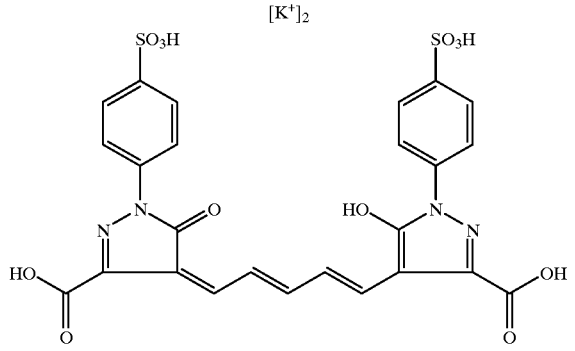

Further this layer can contain hardening agents, matting agents, e.g. silica particles, and wetting agents. At least part of these matting agents and/or light reflection pigments may also be present in the direct positive silver halide emulsion layer the most part however preferably being present in said base-layer.

More details about the composition, preparation and coating of direct positive silver halide emulsions can be found in e.g. Product Licensing Index, Vol. 92, December 1971, publication 9232, p. 107–109.

The hydrophilic layers of the photographic element may contain gelatin, starch, cellulose, colloidal silica, polyvinyl pyrrolidone, etc. as a binder, but especially when the binder used is gelatin, it can be hardened with appropriate hardening agents such as those of the vinylsulfone type e.g. the preferred methylenebis(sulfonyl-ethylene), and further, aldehydes as e.g. formaldehyde, glyoxal, and glutaraldehyde, N-methylol compounds e.g. dimethylolurea and methyloldimethylhydantoin, active halogen compounds e.g. 2,4-dichloro-6-hydroxy-s-triazine, and mucohalogenic acids e.g. mucochloric acid and mucophenoxychloric acid. These hardeners can be used alone or in combination. The binders can also be hardened with fast-reacting hardeners such as carbamoylpyridinium salts of the type, described in U.S. Pat. No. 4,063,952. The hardening agents can be used in wide concentration range but are preferably used in an amount of 4% to 7% of the hydrophilic colloid. Different amounts of hardener can be used in the different layers of the imaging element or the hardening of one layer may be adjusted by the diffusion of a hardener from another layer. The imaging-element used according to the present invention may further comprise various kinds of surface-active agents in the photographic direct positive silver halide emulsion layer or in at least one other hydrophilic colloid layer. Examples of suitable surface-active agents are described in e.g. EP 545452. Preferably compounds containing perfluorinated alkyl groups are used. The photographic material of the present invention may further comprise various other additives such as e.g. compounds improving the dimensional stability of the photographic element, UV-absorbers, spacing agents and plasticizers.

According to present invention the material, made sensitive for red light exposure in the range from 600 up to 700 nm is coated with a total amount of coated silver halide in said film, expressed as an equivalent amount of silver nitrate, in the range from 1.0 to 3.0 g/m$^2$. In a preferred embodiment said film is suitable for use in COM (computer output microfilm) applications, although applications in graphic arts and duplicating techniques are not excluded.

According to the method of the present invention a spectrally sensitized prefogged direct-positive silver halide emulsion for use in at least one light-sensitive layer of the material according to the present invention is thus prepared, said method comprising the steps of formation of a silver halide emulsion by precipitation of aqueous silver and halide salt solutions in a medium having a protective colloid in order to obtain silver halide core-shell emulsion crystals rich in silver bromide having silver bromide in a total amount of at least 80 mole %, further having, in a shell of said core-shell emulsion crystals, silver iodide in a range from 0.5 up to 20.0 mole %, based on silver, said shell representing less than 50 mole % of all silver precipitated;

desalination of said silver halide emulsion;

prefogging of said silver halide emulsion crystals;

adding one or more desensitizing dye having an absorption maximum in the wavelength range from 600 up to 700 nm, if present as a sole dye, and at least one azacyanine dye or a combination of azacyanine dyes having an absorption maximum at a more hypsochromic wavelength versus the absorption maximum of the said desensitizing dye.

According to the method of the present invention the above described photographic material or element is information-wise exposed in an analogous or a digital way to irradiation in the wavelength range from 600 up to 700 nm and is subsequently processed by the steps of developing in a surface developer, being an alkaline processing liquid comprising developing agents, followed by fixing, rinsing and drying, thereby yielding a positive image.

Silver halide developing agents for use in accordance with the present invention are preferably of the p-dihydroxybenzene type, e.g. hydroquinone, methylhydroquinone or chlorohydroquinone, preferably in combination with an auxiliary developing agent being a 1-phenyl-3-pyrazolidinone-type developing agent and/or p-monomethyl-aminophenol. Particularly useful auxiliary developing agents are of the phenidone type e.g. 1-phenyl-3-pyrazolidinone, 1-phenyl-4-monomethyl-3-pyrazolidinone, and 1-phenyl-4,4-dimethyl-3-pyrazolidinone. However other developing agents can be used, more particularly as the material according to the present invention is coated with low amounts of silver. So the ecologically preferred ascorbic acid type developer (comprising 1-ascorbic acid, iso-ascorbic acid or reductic acid) is recommended as one of the developing agents, as disclosed e.g. in JP-A 8-152701, in U.S. Pat. No. 5,780,212 and in EP-A 0 786 698. Said developing agents are preferably contained in an alkaline processing liquid, although incorporation in one or more layers of the photographic material is not excluded. In the latter case the alkaline processing liquid merely serves as an alkaline activating liquid. The pH of said alkaline liquid is preferably between 9 and 14, more preferably between 10 and 13 and may be established by an organic and/or inorganic alkali agent. Examples of suitable alkali agents are e.g. sodium hydroxide, carbonates, phosphates, alkanolamines or mixtures thereof.

The alkaline processing liquid preferably also contains a preserving agent having antioxidation activity, e.g. sulphite ions. Further may be present a thickening agent, fog inhibiting agents, calcium-sequestering compounds, anti-sludge agents, development accelerators and hardeners including latent hardeners. The above described development step is preferably followed by a washing step, a fixing step and another washing or stabilizing step. The first washing step may be omitted.

The photographic material according to the present invention thus yields images of good quality, especially of high contrast at the desired sensitivity level in COM-applications, after processing in a surface developer, followed by a fixation and a rinsing step, of the red light exposed, and more particularly, He—Ne laser exposed direct-positive material as set forth hereinbefore.

EXAMPLES

While the present invention will hereinafter be described in connection with preferred embodiments thereof, it will be understood that it is not intended to limit the invention to those embodiments.

Example 1

1. Preparation of the Emulsions

The following solutions were prepared:

a dispersion medium (C) held at a temperature of 40° C. in a reaction vessel containing 1000 ml of demineralized water, 70 g of inert gelatin and and solutions A, B1 and B2

1000 ml of a silver nitrate solution, 2.94 molar (A); 844 ml of a potassium bromide solution, 2.94 molar (B1), and 156 ml of a mixture containing potassium iodide 1.47 molar and potassium bromide 1.47 molar (B2).

Following emulsions, numbered D–H, differing in silver iodide distribution were prepared as summarized in Table 1.

TABLE 1

| Emulsion | Iodide (5 mole %) distributed over the grain volume |
|---|---|
| D | Homogeneously |
| E | Present in a shell between 10% and 20% of the total amount of precipitated silver halide |
| F | Present in a shell between 50% and 100% of the total amount of precipitated silver halide |
| G | Present in a shell between 75% and 100% of the total amount of precipitated silver halide |
| H | Present in a shell between 90% and 100% of the total amount of precipitated silver halide |

Therefore solutions A, B1 and B2 were added by double jet addition to the reaction vessel containing dispersion medium (C) at such a designated time and in such a way that the running velocity was continuously and linearly changed, in order to get a cubic emulsion grain having an average grain diameter of about 0.090 $\mu$m, wherein iodide ions were distributed as described in the Table 1 hereinbefore.

Then the pH was adjusted to 3.0 with sulphuric acid and the emulsion was flocculated by the addition of sufficient low-molecular weight polystyrene sulphonate solution. The flocculated emulsion was washed thoroughly for several times with water.

Finally the emulsion was redispersed and gelatin and water were added to obtain a final emulsion of about 3.2 kg, having a gelatin to silver ratio (gesi), the latter expressed as silver nitrate, of 0.4, and an average grain size of about 0.09 $\mu$m as set forth hereinbefore. The crystal morphology was essentially cubic as was confirmed by electron microscopy. The composition of the AgBr(I) emulsion was 95 mole % of silver bromide and 5 mole % of silver iodide, based on silver.

Surface fogging of the emulsion was performed for 4.5 hours at 55° C. by addition of thioureumdioxide (in an amount of $7.8\times10^{-6}$ mole per mole of silver halide) and gold salt ($HAuCl_4$ $4.9\times10^{-6}$ mole per mole of silver halide) at a pH of 6.0 and at 70 mV.

2. Preparation of the Materials

In order to prepare the light-sensitive direct-positive materials, coating solution(s) for the light-sensitive and for the outermost protective layer coating solution were applied onto a colorless and transparent polyester support, having a thickness of 100 $\mu$m, coated in advance on the side opposite to the emulsion layer with a backing antihalation layer comprising 2.5 g/m$^2$ of gelatin, hardened with di-vinylsulphone as a hardening agent. Said backing antihalation layer was providing a density of 0.8 at a wavelength of 633 nm by incorporation therein of a antihalation dye according to the formula given hereinafter.

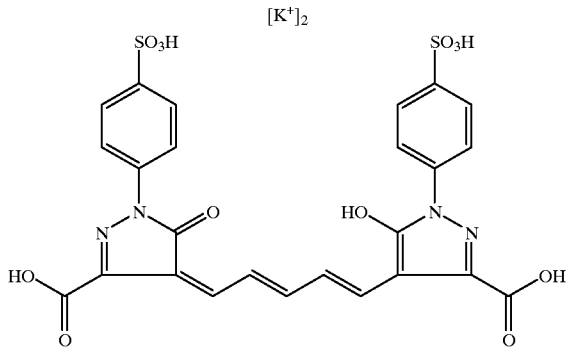

The desensitizing dye according to the formula (I.1) given in the detailed description hereinbefore was added to the light-sensitive emulsion in an amount of 8.7 mmol per mole of silver halide coated. Further to the coating solution(s) of the emulsion layer were added suitable amounts of the stabilizers 5-nitrobenzimidazole and benzimidazole and the normally used coating aid solutions. Coating of the emulsion and of the protective layer was performed by the well-known suitable coating techniques. A single light-sensitive layer was coated, with a total silver coverage of 2.2 g/m2, expressed as the equivalent amount of $AgNO_3$.

3. Evaluation of the Materials

The coated materials Nos. D–H, accordingly coated with the corresponding emulsions D–H in their respective light-sensitive emulsion layers were evaluated after exposure with a He—Ne laser sensitometer having a spot size of 54 $\mu$m, an exposure time of 50 ns and an overlap of 70%.

The processing was performed by processing (developing at 35° C. during 30 s, followed by fixing at 35° C. during 15 s) in ANACOMP® chemistry, known as LaserPos® chemistry.

Sensitivity was determined at a density level of 0.8 above minimum density (a higher figure is indicative for a higher speed).

The materials were also evaluated in praxis by exposing them on a XFP2000 He/Ne Laser COM (trademarked product of ANACOMP), followed by processing as set forth hereinbefore.

Evaluation of those materials was performed by measurement of the density of an illuminated square at a certain illumination or exposure level of the XFP2000 COM®: the lower the density of the "white" square, the higher the sensitivity.

The maximum density was measured on a non-illuminated part of the microfiche.

In the following Table 2 a summary is given of the practical results after evaluation of the emulsions in Materials Nos. D–H.

TABLE 2

| Materials Nos. | Dmin. (×100) | Dmax. (×100) |
|---|---|---|
| D (comp.) | 69 | 290 |
| E (comp.) | 77 | 305 |
| F (comp.) | 97 | 275 |
| G (inv.) | 31 | 295 |
| H (inv.) | 39 | 330 |

Inventive emulsions having iodide in an outermost shell of a core-shell, said shell representing less than 50 mole % of all silver precipitated as emulsion crystals rich in silver bromide, clearly gives better results when coated in direct-positive materials, evaluated in COM-applications as illustrated after exposure in a XFP2000 He/Ne LaserCOM® and processing in the chemistry applied thereto.

4. Spectral Characteristics of the Materials

FIG. 1 shows the absorption spectra of the Materials D and H.

From these spectra it becomes clear that with an emulsion having iodide in an outermost shell of the grains or crystals the absorption maximum is shifted from 640 nm to 670 nm. This means that the spectral characteristics become worse as the maximum is farther away from the desired 633 nm wavelength of the Helium-Neon laser. This means that this spectral shift has to be overcome in order to get an optimized speed.

Example 2

To Emulsion G were added, after fogging treatment with a gold salt and thioureum dioxide, amounts of the imidazo quinoxaline desensitizer (I.1) and of azacyanine (II.17) in order to compare the red light absorption spectra when molar ratio amounts of those dyes were changing from 1:0 (1), to 1:1 (2), 1:2 (3), 1:3 (4) up to 1:4 (5). Absorption spectra were registrated with a UV-VIS spectrophotometer.

Figure 2:
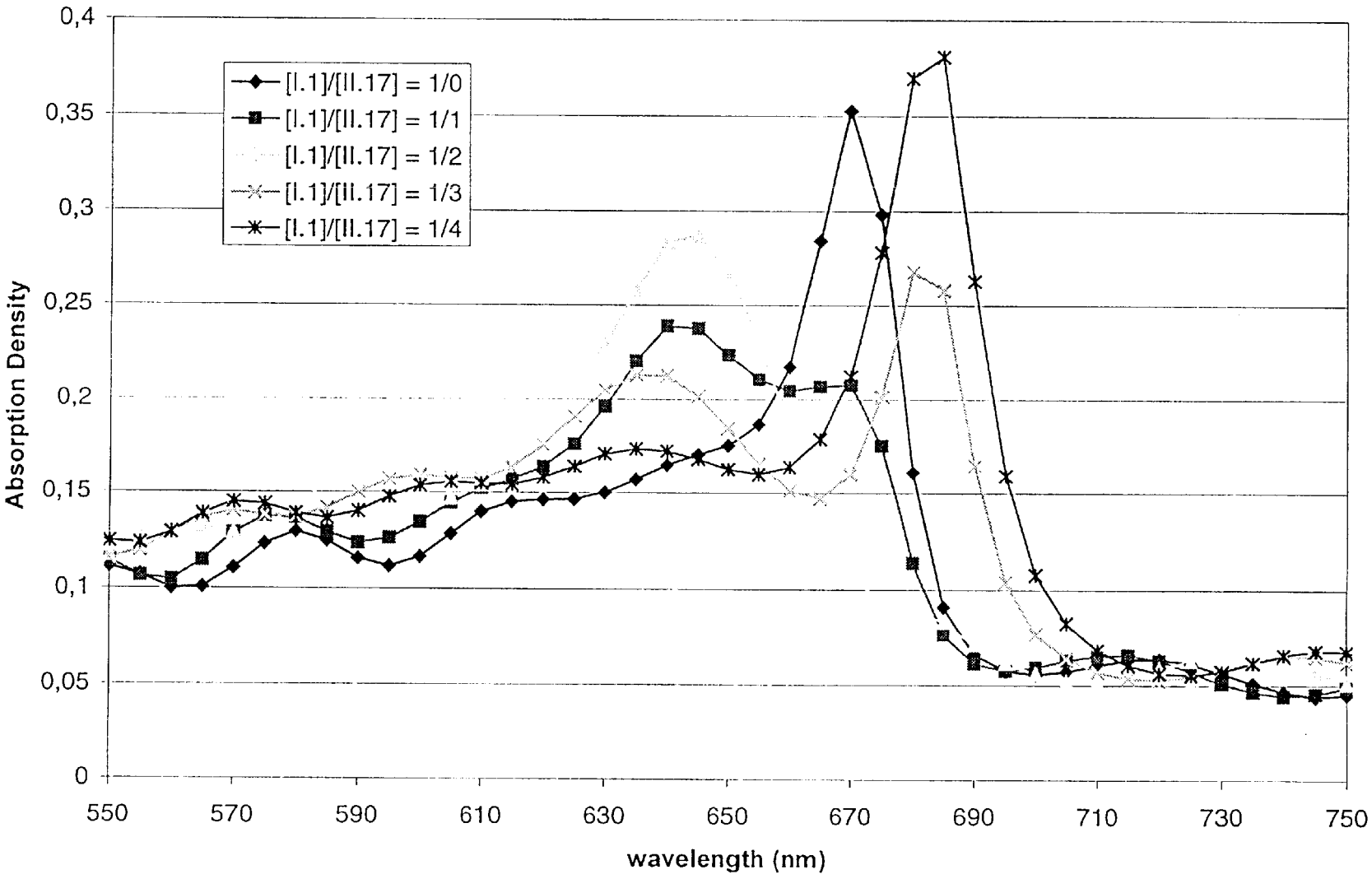
FIG. 2 illustrates the shift in absorption maxima by co-adsorption of desensitizing dye [I.1] and azacyanine dye [II.17] at the surface of the direct-positive silver halide emulsions coated in the materials, wherein curves showing variations of absorption density of the materials have been plotted in a wavelength range from 550 up to 750 nm, for differing molar ratios of both dyes.

FIG. 2 illustrates the shift in absorption maxima by co-adsorption of desensitizing dye and azacyanine dye. Choice of the right molar ratio was enabling to reach the highest attainable speed or sensitivity as has been shown in the following Table 3.

TABLE 3

| I.1/II.17 | Sensitivity | Dmax | Density at 633 nm |
|---|---|---|---|
| 1/0 | 93 | 237 | 0.16 |
| 1/1 | 111 | 227 | 0.22 |
| 1/2 | 122 | 225 | 0.26 |
| 1/3 | 111 | 196 | 0.21 |
| 1/4 | 87 | 201 | 0.17 |

Example 3

To Emulsion G were added, after fogging treatment with a gold salt and thioureum dioxide, amounts of the imidazo quinoxaline desensitizer (I.1) and of azacyanine (II.18), formula given hereinafter) in order to compare the red light absorption spectra when molar ratio amounts of those dyes were changing from 1:0 (1), to 1:1 (2), 1:2 (3), 1:3 (4) up to 1:4 (5). Absorption spectra were registrated with a UV-VIS spectrophotometer.

Figure 3:
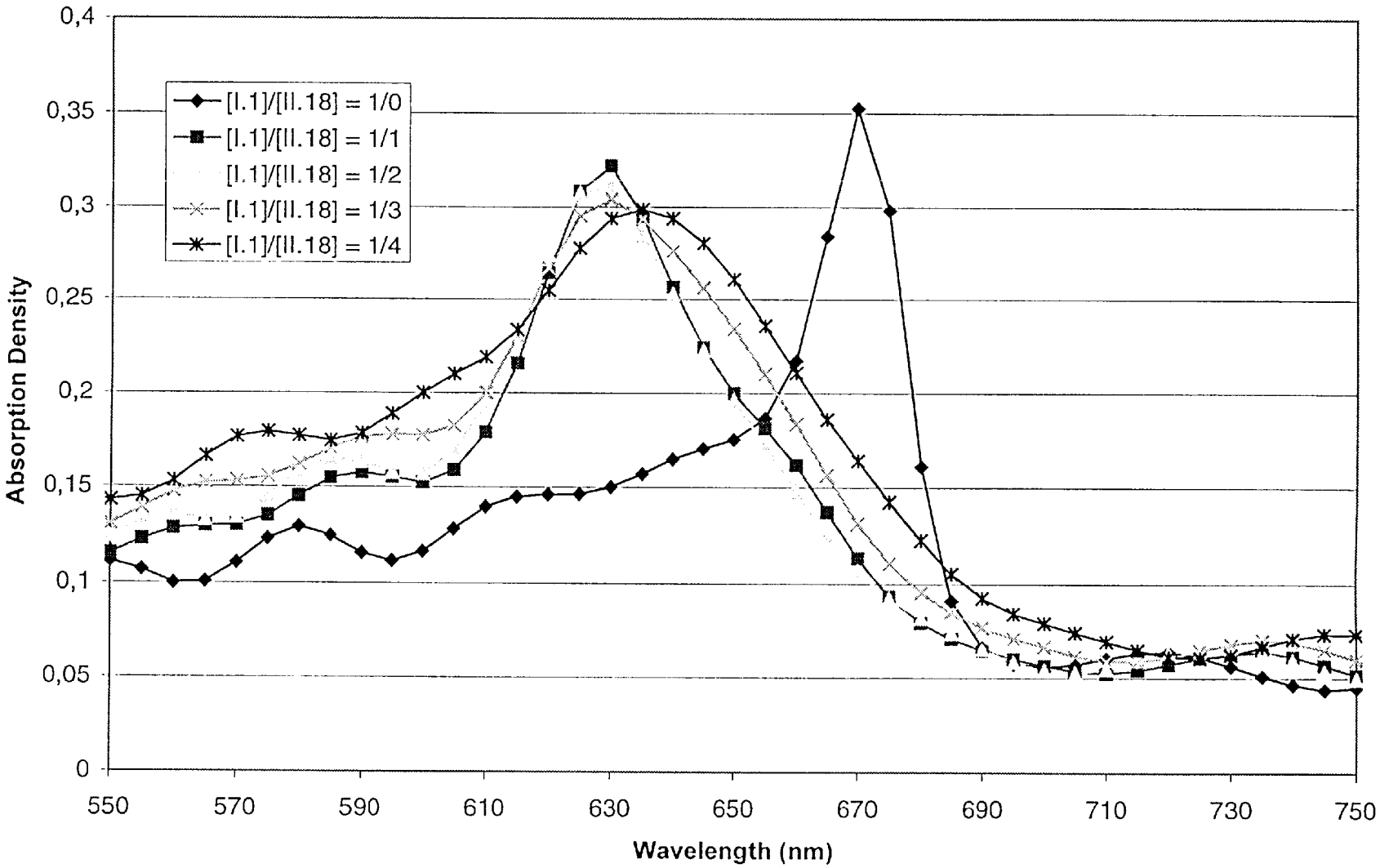
FIG. 3 illustrates the shift in absorption maxima by co-adsorption of desensitizing dye [I.1] and azacyanine dye [II.18] at the surface of the direct-positive silver halide emulsions coated in the materials, wherein curves showing variations of absorption density of the materials have been plotted in a wavelength range from 550 up to 750 nm, for differing molar ratios of both dyes.

FIG. 3 illustrates the shift in absorption maxima.

Dye (II.18)

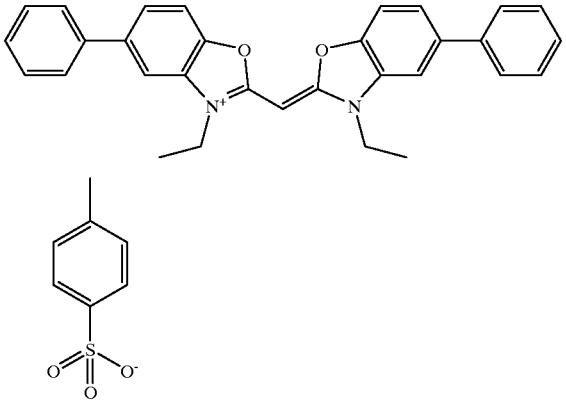

Adsorption spectra of materials coated with emulsion D (5 mole % of silver iodide, homogeneously divided over the volume of the emulsion crystals) gives an absorption spectrum having a maximum around 640 nm if only desensitizing dye (I.1) is added to the emulsion. This makes the said material very useful for a He/Ne Laser exposure.

Adsorbed on an emulsion however where iodide is located in an outermost shell up to the emulsion crystal surface as for emulsion G makes the absorption spectrum change and shows a maximum around 670 nm, so that the material is not optimized for exposure with He/Ne-laser sources.

As has been clearly illustrated in these examples, addition of "co-adsorbing" dyes given in the description and in the claims makes the absorption maximum of the desensitizing dye according to the general formula (I) shift and provide an optimized speed (sensitivity) for dedicated exposures in the red light range of the wavelength spectrum (e.g. for He/Ne laser exposure as illustrated in the previous examples) for a core-shell emulsion rich in silver bromide having iodide, located at and/or in the vicinity of the crystal surface.

Having described in detail preferred embodiments of the current invention, it will now be apparent to those skilled in the art that numerous modifications can be made therein without departing from the scope of the invention as defined in the appending claims.

What is claimed is:

1. Black-and-white silver halide photographic material coated on a support with at least one light-sensitive emulsion layer, comprising a spectrally sensitized prefogged direct-positive silver halide emulsion, providing peak absorption in the wavelength range from 600 nm up to 700 nm, wherein said emulsion comprises a binder and core-shell emulsion crystals having silver bromide in a total amount of at least 80 mole %, further having, in a shell of said core-shell emulsion crystals, silver iodide in a range from 0.5 up to 20 mole %, based on silver, said shell representing less than 50 mole % of all silver precipitated, characterized in that said emulsion is spectrally sensitized with a combination of a desensitizing dye having an absorption maximum wavelength in a range from 600 nm up to 700 nm, if present as a sole dye in said emulsion, and at least one dye having an absorption maximum at a more hypsochromic wavelength, wherein said dye, having an absorption maximum at a more hypsochromic wavelength, is an azacyanine dye.

2. Material according to claim 1, wherein said azacyanine dye corresponds to one of the general formulae (II.1)–(II.5), (II.4') and (II.5') wherein each of the substituents A and A' independently represents hydrogen, an alkyl, an aryl or an aralkyl; wherein R and R' each independently represents an alkyl, an aryl or an aralkyl group; and wherein cations or anions are present in order to compensate the charge of the dye molecule (II-1)

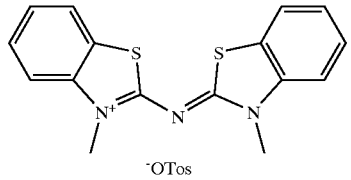

(II-2)

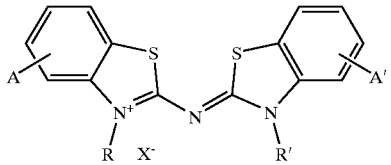

(II-3)

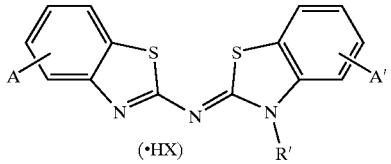

(II-4)

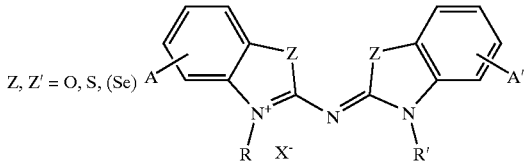

(II-5)

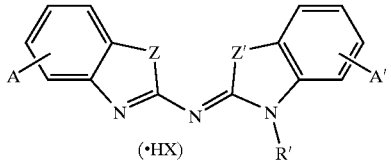

(II-4')

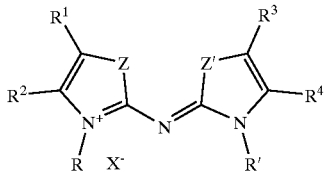

(II-5')

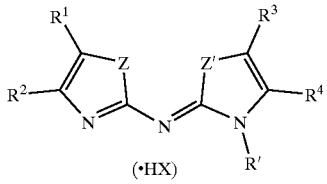

3. Material according to claim 1, wherein said azacyanine dye is a dye according to the formula (II.17)

(II.17)

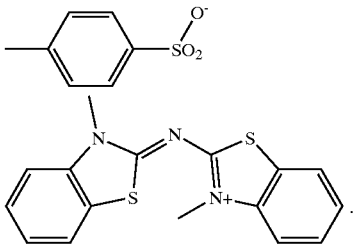

4. Material according to claim 1, wherein said absorption maximum and said hypsochromic wavelength are differing at least 50 nm.

5. Material according to claim 1, wherein said desensitizing dye is represented by the general formula (I)

(I)

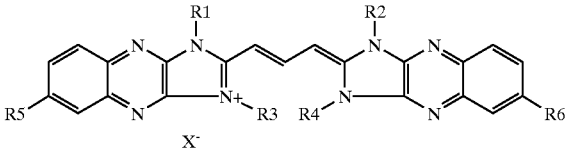

wherein each of R1–R4 each independently represents hydrogen, an (unsubstituted or substituted) alkyl, an (unsubstituted or substituted) aryl or an (unsubstituted or substituted) aralkyl; wherein R5 and R6 each independently represents an electron withdrawing group and wherein $X^-$ represents an anion compensating for the positive charge present in said formula (I).

6. Material according to claim 1, wherein a molar ratio amount between said azacyanine dye(s) on one hand and the said desensitizing dye at the other hand is from 1:1 up to 5:1.

7. Material according to claim 1, wherein said grains rich in silver bromide have iodide in an average molar amount based on silver of from 0.1 mole % up to 10 mole %.

8. Material according to claim 1, wherein said grains rich in silver bromide are cubic grains, having an average crystal diameter in the range from 0.05 to 0.50 $\mu$m.

9. Material according to claim 1, wherein a total amount of coated silver halide in said film, expressed as equivalent amount of silver nitrate, is in the range from 1.0 to 3.0 g/$m^2$.

10. Black-and-white image-forming method comprising the steps of information-wise exposing the said film material according to claim 1 to irradiation in the wavelength range from 600 up to 700 nm;

processing the said film material by the steps of developing in a surface developer, fixing, rinsing and drying.

* * * * *